US007186957B2

(12) United States Patent
Martin

(10) Patent No.: US 7,186,957 B2
(45) Date of Patent: Mar. 6, 2007

(54) TEMPERATURE REGULATED CLOTHING

(75) Inventor: Richard Martin, Sonoma, CA (US)

(73) Assignee: Phoenix Consultants, Ltd. (GB)

( * ) Notice: Subject to any disclaimer, the term of this patent is extended or adjusted under 35 U.S.C. 154(b) by 0 days.

(21) Appl. No.: 10/636,511

(22) Filed: Aug. 6, 2003

(65) Prior Publication Data

US 2004/0118831 A1 Jun. 24, 2004

Related U.S. Application Data

(60) Provisional application No. 60/401,878, filed on Aug. 7, 2002.

(51) Int. Cl.
*H05B 3/34* (2006.01)

(52) U.S. Cl. ..... 219/529; 219/212; 62/3.3

(58) Field of Classification Search ..... 219/211, 219/529, 544, 548, 549, 497, 528; 36/2.6, 36/3 R, 88, 3.62; 62/3.3, 3.5, 3.4, 259.3; 165/46; 2/DIG. 1, 2.11–2.17, 458; 607/104, 607/108

See application file for complete search history.

(56) References Cited

U.S. PATENT DOCUMENTS 2,954,562 A * 10/1960 Krupp ..... 2/2.14
3,085,405 A * 4/1963 Frantti ..... 62/3.5
4,065,936 A * 1/1978 Fenton et al. ..... 62/3.3
4,180,922 A 1/1980 Cieslak
4,586,342 A * 5/1986 Morishita et al. ..... 62/3.4
5,092,129 A * 3/1992 Bayes et al. ..... 62/3.3
5,115,859 A * 5/1992 Roebelen et al. ..... 165/10
5,197,294 A * 3/1993 Galvan et al. ..... 62/3.62
5,266,778 A * 11/1993 Bailey ..... 219/497
5,367,788 A 11/1994 Chen
5,392,534 A * 2/1995 Grim ..... 36/88
5,495,682 A * 3/1996 Chen ..... 36/2.6
5,564,201 A * 10/1996 O'Connell ..... 36/3 R
5,598,971 A 2/1997 Winther et al.
5,800,490 A * 9/1998 Patz et al. ..... 607/108
5,970,718 A 10/1999 Arnold
6,023,932 A 2/2000 Johnston
6,024,575 A * 2/2000 Ulrich ..... 434/236
6,041,518 A * 3/2000 Polycarpe ..... 36/2.6
6,097,088 A 8/2000 Sakuragi
6,125,636 A * 10/2000 Taylor et al. ..... 62/3.5
6,190,342 B1 * 2/2001 Taylor ..... 602/19
6,201,314 B1 * 3/2001 Landry ..... 290/54
6,290,642 B1 9/2001 Reinhard et al.
6,438,964 B1 8/2002 Giblin
6,508,831 B1 * 1/2003 Kushnir ..... 607/104
6,739,138 B2 * 5/2004 Saunders et al. ..... 62/3.3

* cited by examiner

*Primary Examiner*—Thor S. Campbell
(74) *Attorney, Agent, or Firm*—Gary Baker; Quine Intellectual Property Law Group, P.C.

(57) ABSTRACT

Temperature regulated clothing with a thermo-electric module that can be configured to transfer heat to or from the inside of the clothing. The clothing can include, e.g., a control system to maintain a desired internal clothing temperature. The clothing can have, e.g., a circulating coolant system to enhance the rate and/or efficiency of heat transfer.

31 Claims, 10 Drawing Sheets

TEMPERATURE REGULATED CLOTHING

CROSS-REFERENCE TO RELATED APPLICATIONS

This application claims priority to and benefit of prior U.S. Provisional Application No. 60/401,878, "Temperature Regulated Clothing", by Richard Martin, filed Aug. 7, 2002. The full disclosure of the prior application is incorporated herein by reference.

FIELD OF THE INVENTION

This invention is in the field of temperature controlled clothing. The present invention relates to, e.g., clothing warmed or cooled with a battery powered thermoelectric module which transfers heat using the Peltier effect. The temperature controlled clothing of the invention can have, e.g., an integrated circuit to maintain a set temperature. The clothing of the invention can have, e.g., a heat exchange system to increase the efficiency of the temperature control systems.

BACKGROUND OF THE INVENTION

Excessively hot or cold conditions can make clothing uncomfortable for the user. Current solutions to the problem center around garment designs that provide thermal insulation, venting, or heat exchange devices.

A common strategy to keep persons warm is to wear clothing with thick insulation for retention of body heat. This works well in many cases. However, in very cold environments, the required insulation can become prohibitively bulky and heavy. The problem is particularly pronounced in boots and mittens where thick insulation can hinder walking and reduce dexterity.

Another strategy to stay warm is to seal clothing to air circulation. This can hold heat in but also can seal in water vapor. Accumulated water can be uncomfortable and reduce the insulating qualities of the clothing.

Another way to keep warm is to apply heat from an external energy source to heat the inside of a boot, hat, or glove. For example, in U.S. Pat. No. 4,180,922 to Cieslak et al., "Boot Warmer", a burning solid fuel heats a circulating fluid which carries heat into the boot. In this device, the user ignites a fuel and then periodically presses a bladder style pump with his finger to circulate hot fluid into the boot. Such a device can present a fire danger, starts slowly, and requires excessive attention from the user.

Another example of a heated boot is described in U.S. Pat. No. 6,041,518 to Polycarpe, "Climate Controlled Shoe", wherein a battery supplies energy to a heating plate in the sole of the boot. The heating plate transfers heat to air circulating through ducts and partitions in the boot to warm the foot. This boot has bulky duct structures, lacks thermostatic control, and the heat energy is limited to the battery charge.

Cooling of clothing can be desirable to provide comfort where climatic conditions are hot or where the user is engaged with strenuous exercise. Cooling can be provided in clothing articles, by installing loose weave fabric panels in the clothing that allow the shoe to "breathe." Hot air and water vapor can escape through the panels. Such breathing panels are limited to release of hot moist air but do not directly cool the feet. Breathing panels do not seal the clothing and can allow rain to enter the clothing. The climate controlled boot of Polycarpe attempts to address these problems with a battery powered fan to blow fresh air inside a sealed boot to cool and dry the foot. Still, the device merely vents the foot without actually absorbing heat from inside the boot.

Heating and cooling of a military "g"-suit is described in U.S. Pat. No. 6,290,642 to Reinhard et al., "Acceleration Protective Suit." A pressurized g-suit is used to force blood into a pilot's brain to retain consciousness during high speed maneuvers of a fighter jet aircraft. However, the suit is sealed and bulky, causing the pilot to overheat while the jet sits with the engine and climate control systems off during preflight preparations. The acceleration suit can be provided with Peltier effect elements, powered by a large external power source, to warm or cool the torso of the pilot. This "g"-suit does not provide direct temperature control of extremities. Furthermore, the heat transfer efficiency of the Peltier effect elements compromised by the lack of heat conduction and dissipation systems.

In view of the above, a need exists for portable temperature regulated clothing to provide comfort in hot or cold environments. A need remains for clothing that can be efficiently and controllably temperature adjusted while sealed against wind and water in the environment. The present invention provides these and other features that will be apparent upon review of the following.

SUMMARY OF THE INVENTION

The present invention provides, e.g., portable temperature regulated articles of clothing. The clothing of the invention can include, e.g., a Peltier effect thermo-electric module, an electronic temperature control system, and one or more circulating coolant loops. The present invention includes, e.g., methods of regulating the temperature of clothing.

Temperature regulated non-pressurized clothing of the invention include, e.g., a thermoelectric module in electrical contact with an electrical power source. The clothing of the invention can be shirts, shorts or pants but the invention is particularly well suited to provide, e.g., temperature regulated headwear, handwear, and footwear.

The thermoelectric module of the invention can transfer heat from one side (cold side) to the other side (warm side), e.g., according to the polarity of direct current power supplied. The thermo-electric module can be, e.g., in electrical contact, with a portable power source polarized to orient heat transfer out of the clothing and/or to transfer heat into the clothing. Alternately, e.g., the power supply polarization can remain constant and the thermoelectric module can simply be turned over, on a reversible mount, to have either the cold side facing inward or the warm side facing inward.

The thermoelectric module can be in contact with, e.g., a heat conductor plate or circulating coolant loop to disperse heat inside the clothing during warming operations or to collect heat from inside the clothing during cooling operations. To collect and remove water condensation during cooling operations, a drainage tube can be, e.g., associated with the cold side of the thermo-electric module to provide a drainage conduit.

The clothing of the invention can be provided, e.g., with an electronic temperature control system comprising a thermostatic feedback system to modulate power to the thermoelectric module. A temperature sensor mounted to the clothing can, e.g., send a signal to a control circuit indicating the temperature inside the clothing. The solid state power control circuit can have, e.g., temperature signal input terminals in communication with the temperature sensor (such as a thermistor or thermocouple), a controlled power output terminal in electrical contact with the thermo-electric module, and a power input terminals in contact with a battery (such as a rechargeable battery). The power control circuit can, e.g., adjust the power supplied to the thermo-electric module in response to the temperature sensor signal to control the clothing temperature. A temperature selection device can be, e.g., in electrical contact with control circuit temperature selection input terminals so that a desired clothing temperature can be selected by the user. The solid state circuit can be, e.g., one or more circuit board, integrated circuit, EPROM, and/or the like.

The clothing of the invention can have, e.g., one or more circulating coolant loops to accelerate transfer of heat to and/or from the thermoelectric module. The circulating coolant loops can include, e.g., an internal heat exchanger, an external heat exchanger, and a circulation pump connected a fluid conduit loop. The internal heat exchanger can have, e.g., coolant channels with coolant fluid to exchange heat with one side of the thermoelectric module. The external heat exchanger can be mounted, e.g., on the outer surface of the clothing and receive coolant into coolant channels from the internal heat exchanger. The circulation pump can be, e.g., fluidly coupled to the coolant channels in the heat exchangers to complete the circulating loop.

The heat exchangers can have additional elements to aid in the conduction and dissipation of heat. The internal heat exchanger can have a heat exchanger plate and/or circulating coolant loop in contact with one side of the thermo-electric module to collect or distribute heat from inside the clothing. The external heat exchanger can have, e.g., copper, aluminum, or bronze heat exchange fins. The external heat exchanger can have, e.g., a thermal insulation backing layer to reduce heat exchange between the exchanger and the clothing.

The circulating pump can be of any suitable design known in the art. For example, the pump can comprise one or more chambers, and two or more check valves directing coolant flow through the chambers and the loop. The circulating pump chamber can be, e.g., a resilient bladder, rotary pump chambers, a cylinder sealed with a piston, and/or the like. The check valves can be configured as, e.g., reed valves, or ball and seat valves. The circulating pump can be a dual action pump, e.g., to circulate fluid through two coolant loops using one pump.

In one aspect of the invention, the clothing is footwear with a piston type circulating pump. For example, the circulating piston pump can have a piston plate hydraulically sealed (e.g., with a neoprene o-ring) and slidably mounted within a cylinder wall. An actuator shaft can be, e.g., attached to the piston plate, and extend over a fulcrum, to a shaft anchor mounted to a sole of the footwear. The piston pump can have, e.g., a return spring compressed between one side of the piston plate and a pump chamber wall to urge the piston plate to a starting position between pump strokes.

A coolant fluid can circulate, e.g., around a loop of heat exchangers and the pump filling the associated chambers, channels, and tubing. The coolant fluid can be any liquid with suitable viscosity, heat capacity, stability and materials compatibility, such as water, mineral oil or silicone oil. Coolant fluid can carry heat, e.g., from a hot side of a TEM or to a cold side of a TEM.

In one embodiment of the invention, for example, the temperature regulated non-pressurized clothing includes a battery powered thermoelectric module, controlled by a power control circuit and associated with a heat transferring circulating coolant loop. All of the components can be mounted to the clothing. A solid state power control circuit can provide, e.g., a temperature selection input terminal in communication with a temperature selection device, a temperature signal input in communication with a temperature sensor, an electrical power input terminal in contact with a battery, and a power output terminal in contact with one side of a thermoelectric module. The control circuit can, e.g., receive a user selected temperature setting, determine the clothing temperature, and transfer power from the battery to the thermo-electric module, as appropriate. A circulating coolant loop can contain a coolant fluid and provide, e.g., an internal heat exchanger with first coolant channels in contact with one side of the thermo-electric module, an external heat exchanger mounted on an outer surface of the clothing with second coolant channels fluidly coupled to the first coolant channels, and a circulation pump fluidly coupled to the first and second coolant channels to transfer heat between the heat exchangers in the coolant fluid. In operation, control circuits can, e.g., monitor the temperature at the temperature sensor and adjust the power supplied to the thermoelectric module to regulate the clothing temperature while the heat is exchanged between the thermoelectric module and the heat exchangers to increase the efficiency of the clothing temperature regulation.

The present invention includes methods of regulating temperatures in non-pressurized clothing. For example, a thermoelectric module can be incorporated into the clothing and electric power applied. A lower clothing temperature can be selected, e.g., by polarizing the electric power to orient heat transfer out of the clothing. An increased clothing temperature can be selected, e.g., by polarizing the electric power to orient heat transfer out of the clothing.

DETAILED DESCRIPTION

The present invention provides, e.g., temperature regulated articles of clothing. The invention can include, e.g., a Peltier effect thermoelectric module (TEM) capable of transferring heat into or out of the clothing. The present invention can include, e.g., an electronic temperature control system for selecting and controlling the clothing temperature. In another aspect of the invention, one or more circulating coolant loops are provided, e.g., to increase the efficiently of heat transfer into or out of the clothing.

Articles of clothing of the invention can be, e.g., individual articles affecting the thermal comfort of the wearer. TEMs of the invention can be beneficially provided, e.g., in clothing for the extremities, tight clothing, sealed clothing, and insulated clothing. Clothing of the invention can include, e.g., handwear, such as gloves, gauntlets, and mittens. Clothing of the invention can include, e.g., footwear, such as boots and shoes. Clothing of the invention can include, e.g., headwear, such as hats and helmets.

Figure 1:
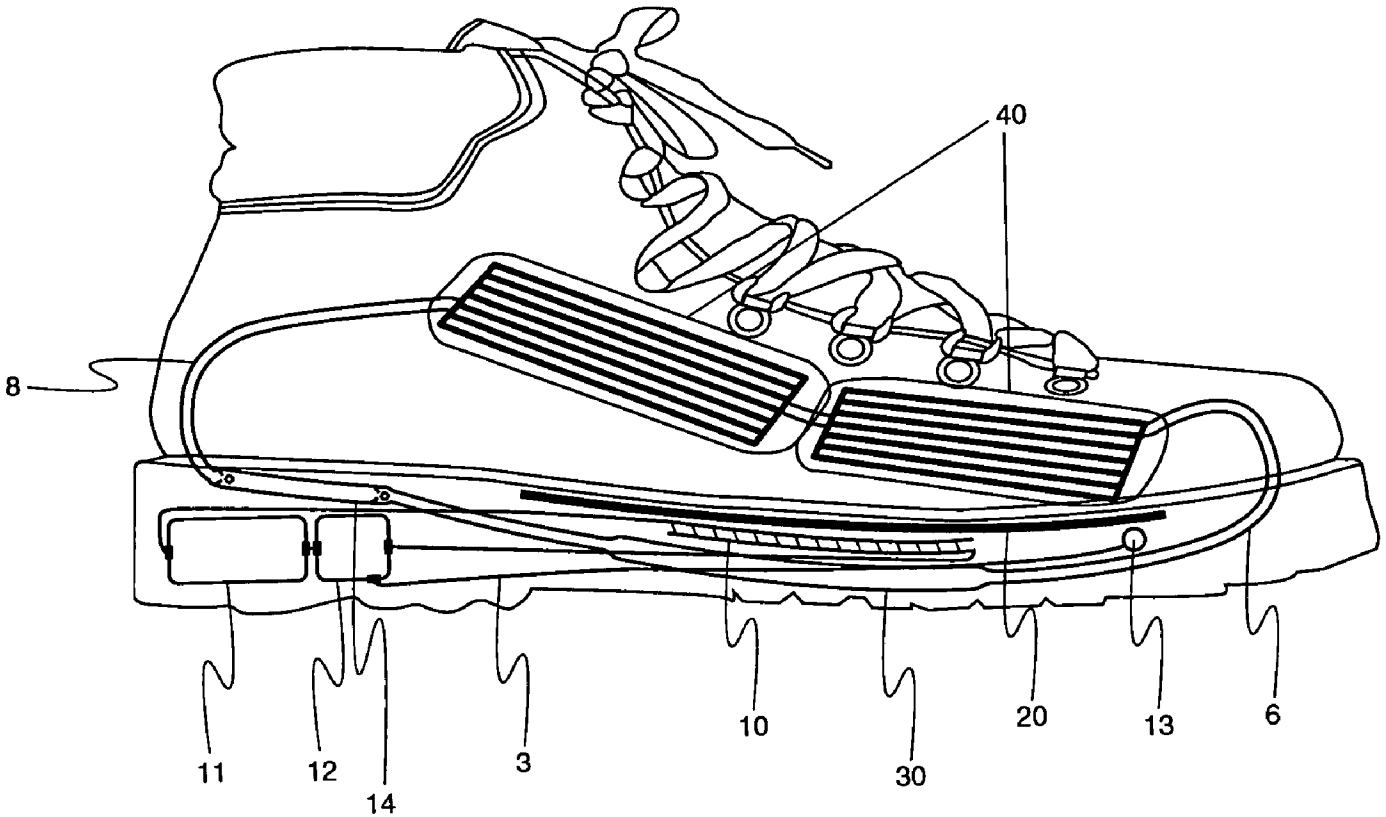
FIG. 1 is a schematic diagram of an exemplary temperature regulated shoe.

In a cooling mode embodiment of the invention, as shown for example in FIG. 1, thermo-electric module (TEM) 10 is implanted within the fabric of a shoe clothing with the cold side facing inward. Battery 11 power to TEM 10 can be controlled by solid state control circuit 12 which responds to a temperature signal, transmitted through sensor connection 3, from temperature sensor 13 in the clothing. A circulating coolant loop, with a coolant fluid, pump 14, coolant fluid conduits 6 and 8, internal heat exchanger 30 and external heat exchanger 40 (mounted to outer surface 41), can remove heat from the warm side of the TEM. When the temperature sensor detects heat above the temperature setting, the control circuit provides voltage to the TEM. As electrical current passes through the TEM, heat is transferred from the cold side to the warm side where it is absorbed by coolant in the internal heat exchanger. The pump circulates warm coolant from the internal heat exchanger to the external heat exchanger where it is dissipated from cooling fins into the air. Removal of heat from inside the shoe continues until the temperature sensor detects a temperature at or below the setting.

The temperature regulated clothing of the invention can be reconfigured for warming, e.g., by simply installing the TEM with the warm side facing inward or by reversing the polarity of the direct current supplied to the TEM. In the warming applications, efficiency of the TEM heat transfer can be increased, e.g., by circulating heat from outside of the clothing to warm the cold side of the TEM.

The Thermo-Electric Module

The thermoelectric module (TEM) of the invention includes, e.g., solid state materials exhibiting the Peltier effect. It has been known since the mid 1800s that some dissimilar metals, having different temperatures at a point of contact (a thermocouple junction), develop a voltage proportional to the temperature difference at the contact point. French physicist, Jean Peltier, discovered that if voltage is applied across a thermocouple junction, the temperature increases on one side of the junction and decreases on the other side. Modern embodiments utilize an N-P junction of solid state semiconductor materials to provide Peltier effect heating and cooling when voltage is applied.

The TEM of the invention can beneficially be formed from, e.g., a planar thermocouple junction. A TEM configured as a planar sheet is well adapted to clothing of the invention. A TEM sheet can be, e.g., incorporated neatly within flat fabric materials of clothing articles. A planar TEM configuration increases the heat transfer surface area for higher power and efficiency. Useful TEMs of the invention are commercially available. Substantially flexible TEMs capable of conforming to the shape of clothing articles are described, e.g., in U.S. Pat. No. 6,097,088 to Reinhard et al., "Thermoelectric Element and Cooling or Heating Provided with the Same".

The power of a TEM can be influenced, e.g., by the overall surface area of the TEM, the temperature difference across the junction, and the amount of current passing through the TEM. A larger TEM can have a greater heat transfer capacity by simply having more junction surface. TEM heat transfer power can be increased by removing heat as it is transferred to the warm side and/or by adding heat to the cool side. This increases heat transfer by conductivity, but also, e.g., by lowering the threshold voltage required to transfer additional heat across the junction. Heat transfer power can be increased, e.g., by increasing the current across the TEM. This can generally be controlled, e.g., by increasing the voltage supplied across the resistance of the TEM junction (current=voltage/resistance).

The temperature regulated clothing of the invention can simply comprise, e.g., a TEM in an electrical circuit with a battery pack and integrated into the fabric of the clothing. An electrical circuit can be formed, e.g., by connecting one electrical lead wire between the battery anode and one side of the TEM junction and another lead wire between the cathode and the other side of the TEM junction. An on/off switch can be provided for the user to control heat transfer by the TEM. With the lead wires polarized in the circuit to orient heat transfer outward (cold side in), heat will be, e.g., removed from the inside of the clothing and transferred to the outside of the clothing, where it can be dissipated into the air or on contact with surfaces. When cooling is adequate, the user can open the circuit at the on/off switch to save energy and avoid over-cooling.

The direct current power source can be, e.g., alternately connected in two polarities to control which side of the TEM is the cold side and which side is the warm side. For example, a first lead wire, in electrical contact with the first side of a TEM junction, can be connected with a battery anode. A second lead wire, in electrical contact with the second side of the TEM junction, can be connected, e.g., to the battery cathode. With the TEM lead wires polarized in this fashion, e.g., the cold side can face in and heat can be transferred out of the clothing. With the TEM lead wires polarized with the first lead wire in contact with the battery cathode and the second lead wire in contact with the battery anode, e.g., the warm side can face in and heat can be transferred into the clothing. Changing the electrical polarization of the lead wires can be accomplished, e.g., by switching lead wire battery contacts and/or by switching polarization of control circuit power output terminals.

The direction of heat transfer can be controlled by changing, e.g., the orientation of the TEM. The TEM can be, e.g., reversibly mounted in the clothing so the user can place the TEM with either the warm side or cold side facing in. For example, the TEM can be removably mounted within a slot in the sole of a shoe or within a fabric flap inside a mitten. In the summer, e.g., the user can have the TEM cold side facing in, then the user can replace the TEM with the warm side facing in for the winter.

The TEM can be provided, e.g., with a heat conductive plate to protect the TEM and to help speed the transmission of heat to and from the TEM. A heat conductive plate can be, e.g., closely bonded to the TEM to provide efficient transfer of heat. Heat conductive plates can be fabricated, e.g., from any suitably rugged and heat conductive material, such as steel, aluminum, copper, and the like.

The TEM can be provided, e.g., with a condensation drain tube to remove water from the cold side of the TEM. The inside of clothing articles can be a humid environment. When the TEM of the invention is configured, e.g., with the cold side facing in, water can condense on the sold surface of the TEM and/or heat conductive plate. To prevent accumulation of water inside the clothing, condensation can be, e.g., channeled and drained out of the clothing with a condensation drain tube.

By transferring ambient heat from the cold side to the warm side, the TEM can, e.g., provide more heat energy than the electrical energy input. In this way, the TEM can, e.g., provide more heat from a battery than a simple resistive hot plate. The high efficiency of a TEM acting as a heat pump can be realized, e.g., when a heat differential across the junction is minimized by using heat exchangers and/or heat sinks on sides of the TEM.

Figure 2:
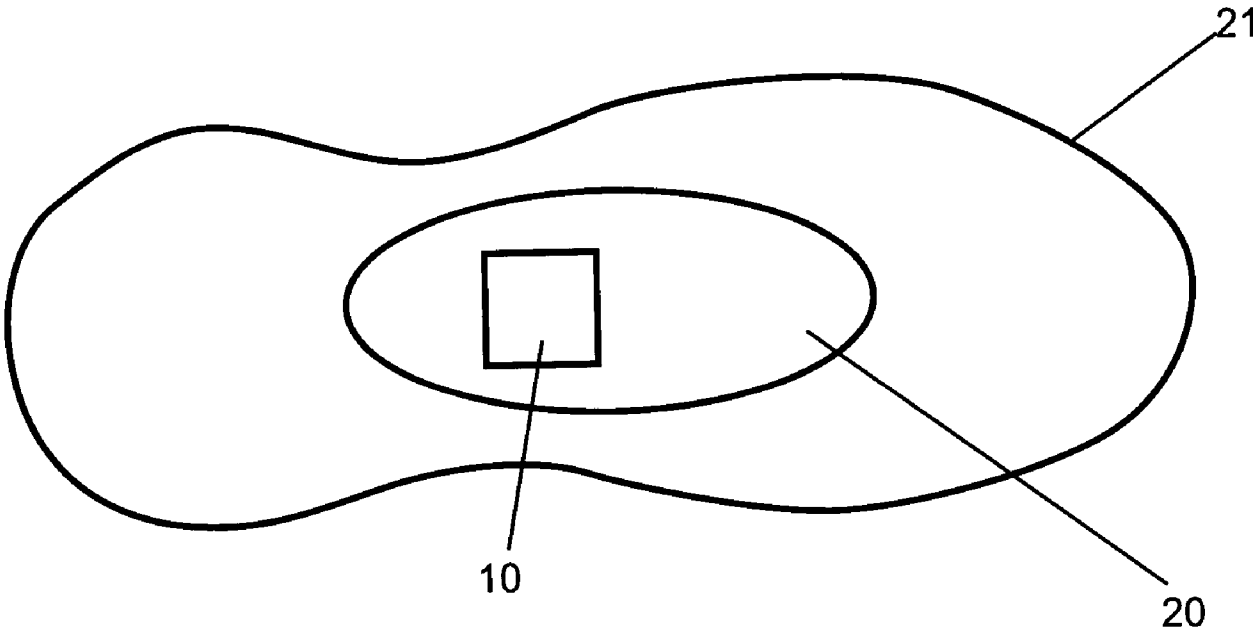
FIG. 2 is a schematic diagram of temperature regulated footwear sole.

A heat conductor plate can be provided, e.g., to increase the heat transfer surface area and to conduct heat between the TEM and the clothing interior. For example, as shown in FIG. 2, heat conductor plate 20 can be integrated into sole 21 and closely bonded to TEM 10 to facilitate the transfer of heat. During cooling operations the heat conductor can, e.g., absorb heat from the interior of the clothing and conduct it to the cold side of the TEM where it is transferred to the warm side of the TEM to be dissipated. During warming operations the heat conductor plate can, e.g., absorb heat from the warm side of the TEM and distribute it evenly inside the interior of the clothing. The heat conductor can be fabricated from, e.g., any suitable heat conductive material, such as copper, silver, aluminum, and the like.

The temperature regulated clothing of the invention can include, e.g., an electronic temperature control system to provide consistent temperature control and user convenience. For example, the control system can have a control circuit with temperature selection input terminals, temperature signal input terminals, and TEM power output terminals. The user can, e.g., turn a dial (or press a digital input keypad) on a temperature selection device in electrical contact with the controller, to set a desired temperature. The controller can, e.g., receive a signal through electrical contact with a temperature sensor, compare it to the temperature setting, and adjust the voltage applied to the TEM, as appropriate, to establish the desired temperature.

The Temperature Selection Device

The temperature selection device of the invention can be, e.g., any selection device known in the art appropriate to the associated control circuit. For example, a variable resister with a calibrated dial can be a temperature selection input device for commonly available analog integrated control circuits. In another example, a digital temperature selector with an LED read-out can provide an appropriate temperature selection input for a digital control circuit.

The Temperature Sensor

The temperature sensor of the invention can be, e.g., any sensor known in the art which can provide an appropriate temperature signal to the control circuit. For example, the temperature sensor can be a thermistor that changes electrical resistance with changing temperature. The temperature sensor can be, e.g., a thermocouple that changes voltage with temperature changes. The control circuit can, e.g., detect the level of resistance or voltage across the input terminals to determine the temperature inside the clothing. An analog to digital converter can be provided, e.g., to supply a digital temperature signal for input to a digital control circuit.

The Power Control Circuit

The power control circuit of the invention can be any suitable control circuit known in the art. The control circuit can be, e.g., one or more solid state circuits compatible with the associated input and output devices of the invention. The control circuit can, e.g., compare a temperature selection input to a temperature signal input and determine an appropriate power output response.

Figure 3:
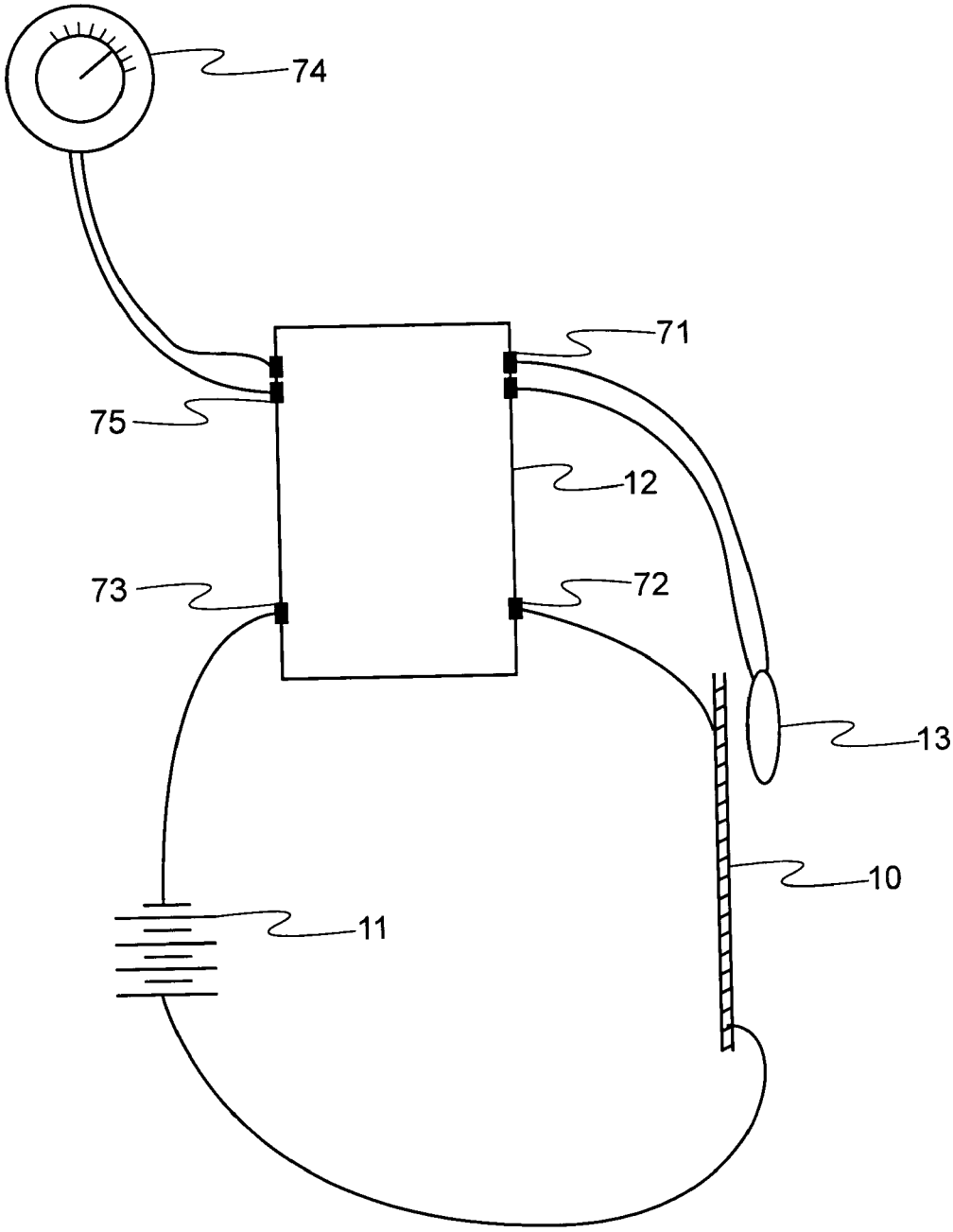
FIG. 3 is a schematic diagram of a power control circuit.

Power control circuit 12 can include, e.g., a logic circuit that compares input signals to determine an appropriate output voltage. For example, as shown in FIG. 3, power control circuit 12 can compare, e.g., the resistance of temperature selection device 74 to the resistance of temperature sensor thermistor 13 to determine an appropriate power output response. Power control circuit 12 can measure the level of electrical resistance across temperature selection input terminals 75 and across temperature signal input terminals 71. If the resistance is greater across temperature signal input terminals 71, e.g., then power control circuit 12 can apply voltage to power output terminal 72 to cool the clothing. As the clothing cools, e.g., the resistance of temperature sensor thermistor 13 can drop. If the resistance of temperature sensor thermistor 13 is equal or more than the resistance of temperature selection device 74, then power control circuit 12 can, e.g., stop applying voltage to power output terminal 72. In one aspect of the invention, a preset internal reference can be substituted for the user operated temperature selection device.

The power control circuit can include, e.g., a logic circuit that compares input signals to determine an appropriate power output polarization. Such a circuit can, e.g., appropriately select between heating and cooling modes of operation. The control circuit can compare, e.g., the resistance of a temperature selection device to the resistance of a temperature sensor thermistor to determine an appropriate power output polarization. For example, the control circuit can measure the level of electrical resistance across the temperature selection input terminals and across the temperature signal input terminals. If the resistance is greater across the temperature signal input terminals, then the control circuit can apply, e.g., negative to positive polarized voltage across the power output terminals to cool the clothing. Alternately, if the resistance is less across the temperature signal input terminals, then the control circuit can apply, e.g., positive to negative polarized voltage across the power output terminals to warm the clothing.

The control circuit of the invention can be, e.g., programmed to accommodate various input devices, output devices and/or operational schemes. The controller can be, e.g., preprogrammed (hard wired) with specific circuits for particular temperature regulation hardware. The controller can be, e.g., an electronically programmable read only memory (EPROM) programmable to provide appropriate output responses to inputs from any of a variety of available temperature selection devices and/or temperature sensors.

The control circuit can include, e.g., a power transistor to control the voltage and/or current output at the power output terminals. The power transistor can be, e.g., controllable by the logic circuits of the control circuit.

The Battery

The battery of the invention can be, e.g., mounted in the clothing in electrical contact with a TEM or control circuit. The battery can be, e.g., a standard battery type providing a voltage appropriate to the TEM.

The battery can be mounted, e.g., in any convenient position where power input leads can be routed between the battery and the TEM or control circuit. For example, the battery can be mounted on the clothing, in the clothing, or strapped onto the body of the user. The battery can be mounted, e.g., within a cavity in the heal of footwear, on a wrist strap, or a waist belt. The battery can be mounted in a cavity or container with a water resistant seal. The battery mount can include, e.g., anode and cathode contacts, connected to the leads, to receive the battery voltage potential. In some embodiments of the invention, the polarization of battery leads can, e.g., control the direction of heat transfer by the TEM. As batteries can give off heat in use, mounting on clothing interiors is well adapted to, e.g., a warming embodiment and exterior mounting is well adapted to a cooling embodiment.

The battery can be of any type known in the art capable of supplying, e.g., the voltage and/or current required by the TEM of the invention. The battery can be, e.g., one or more carbon battery, alkaline cell, lead-sulfate cell, NiCad rechargeable battery, and/or the like. The battery can be selected, e.g., to provide an optimal voltage for the particular TEM. Batteries can be connected in series, e.g., to provide higher voltages and/or capacity, as necessary. Batteries can be connected in parallel, e.g., to provide more capacity without raising the output voltage.

The Circulating Coolant Loop

A circulating coolant loop can be provided in the temperature regulated clothing, e.g., to accelerate transfer of heat between the TEM, the inside of the clothing and/or and the environment outside the clothing. Such accelerated transfer of heat can, e.g., reduce the size of the required TEM, speed heating or cooling of the clothing interior, and/or increase the efficiency of heating or cooling.

A circulating coolant loop can include, e.g., a coolant fluid circulated with a pump through internal and/or external heat exchangers. The heat exchangers can act as, e.g., heat sinks or radiators depending on the direction of heat flow. The circulation pump can be actuated, e.g., by body motions of the user.

The Internal Heat Exchanger

The internal heat exchanger can be, e.g., in close contact with the TEM to remove heat from a warm side during clothing cooling operations or to apply heat to a cold side during a clothing warming operation. A coolant fluid can be circulated, e.g., through a network of channels within the internal heat exchanger to carry heat to or from the internal heat exchanger and TEM, as appropriate. The internal heat exchanger can be, e.g., part of a circulating coolant loop in fluid communication with an external heat exchanger and circulation pump.

Figure 4:
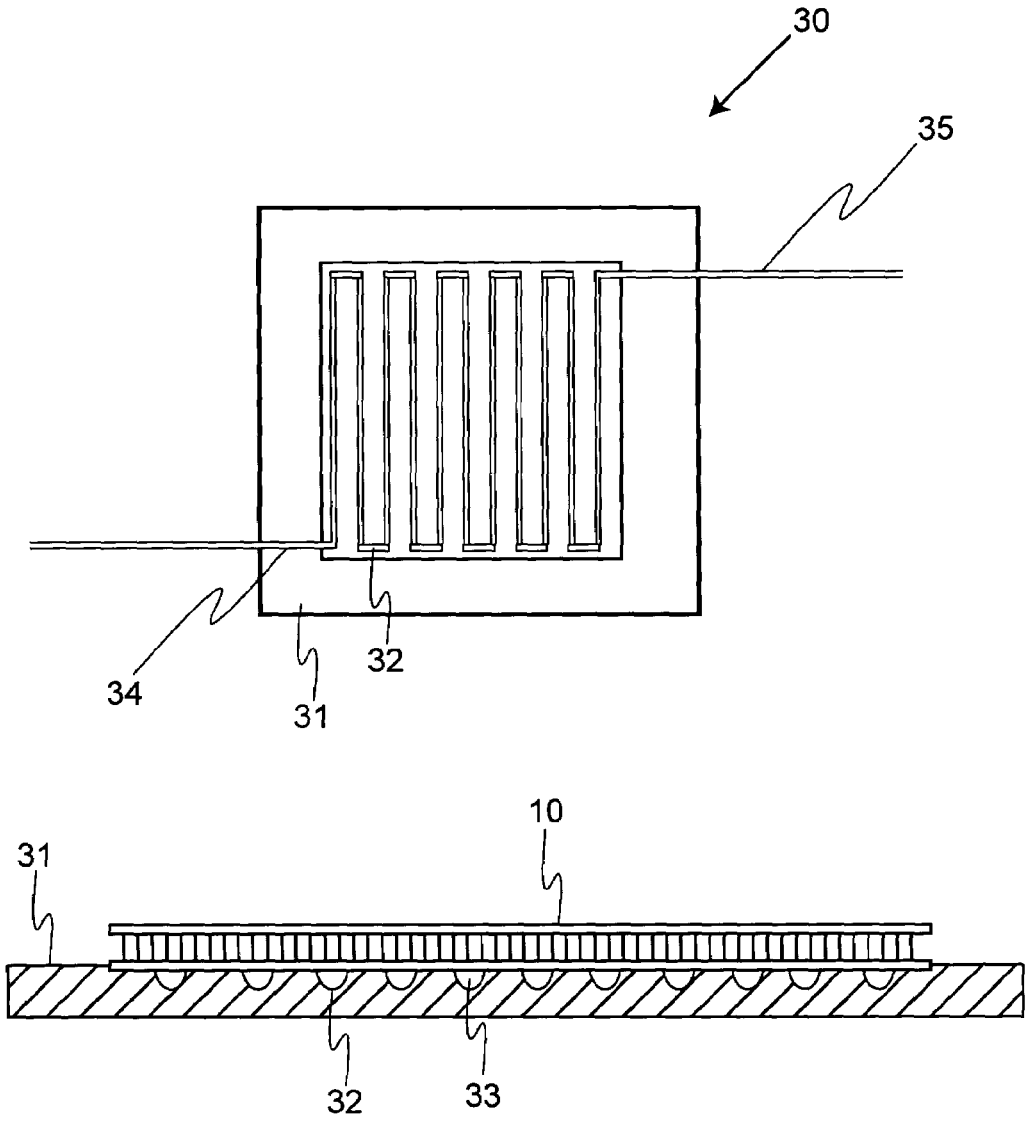
FIG. 4 provides schematic diagram views of a TEM and internal heat exchanger.

Internal heat exchanger 30 can include, e.g., a heat exchanger plate 31 with a network of coolant channels 32 in contact with one side of TEM 10, as shown in FIG. 4. The internal heat exchanger can include, e.g., coolant fluid 33 circulating through one or more inlet ports 34 to a series of sequential and/or parallel coolant channels laid out in a substantially planar network. The coolant can circulate out one or more outlet ports 35 to complete the circulation loop through the external heat exchanger and circulation pump.

The External Heat Exchanger

An external heat exchanger can be, e.g., mounted to the outside of the clothing to dissipate heat during cooling operations or to absorb heat during warming operations. Optionally an external heat exchanger can be, e.g., mounted to the inside of the clothing to receive heat during cooling operations or to release heat during warming operations. A coolant fluid can be circulated, e.g., through a network of channels in an exchanger block to carry heat to or from the external heat exchanger, as appropriate. The external heat exchanger can be, e.g., part of a circulating coolant loop in fluid communication with an internal heat exchanger and circulation pump.

Figure 5:
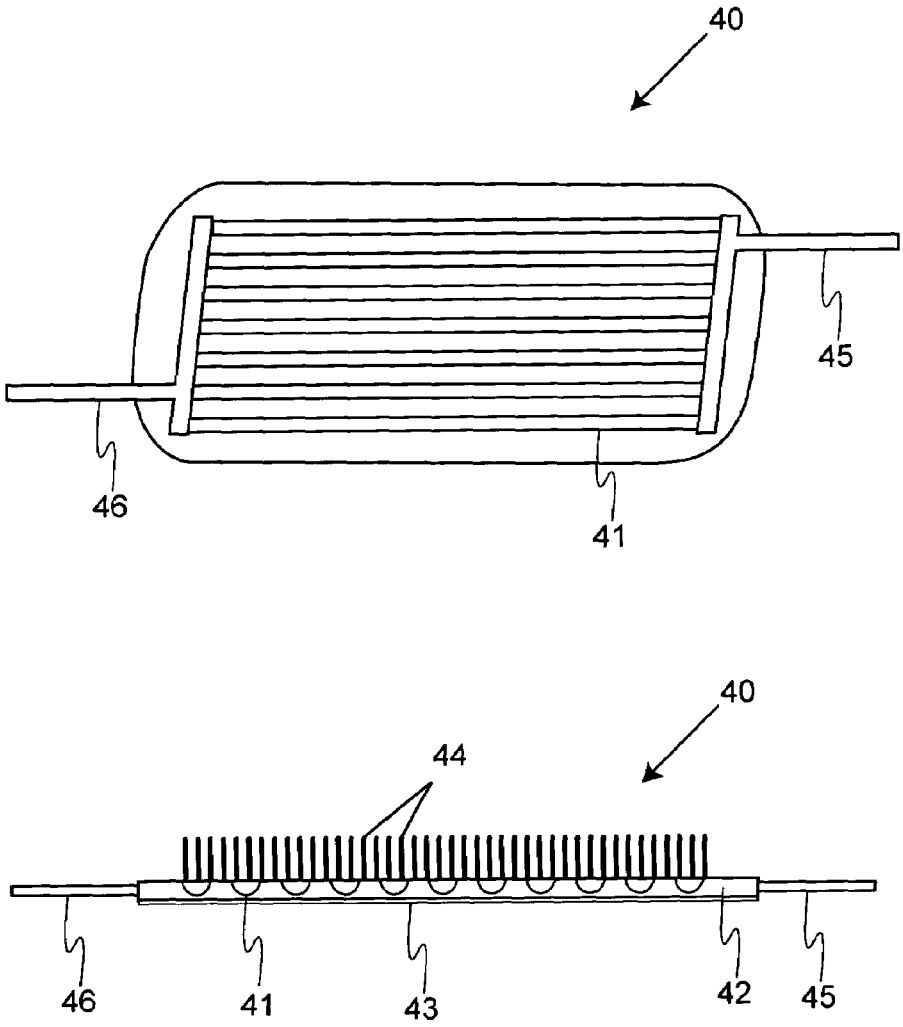
FIG. 5 provides schematic diagram views of an external heat exchanger.

External heat exchanger 40 can include, e.g., a network of coolant channels 41 within external heat exchanger block 42, as shown in FIG. 5. The external heat exchanger can include, e.g., insulating back plate 43 to reduce heat transfer in unintended directions. The external heat exchanger can include, e.g., one or more heat exchange fins 44 extending out from the external heat exchanger to dissipate heat into the air in cooling operations, receive heat from a wearer in cooling operations, to absorb heat from the air in warming operations, or to release heat to a wearer in warming operations. The external heat exchanger can include, e.g., coolant fluid 33 circulating through one or more inlet ports 45 to a series of sequential and/or parallel coolant channels 41 laid out in a substantially planar network. The coolant can circulate out one or more outlet ports 46 to complete the circulation loop through the circulation pump and internal heat exchanger.

The external heat exchanger, e.g., absorbs heat from the wearer or surrounding air, or radiates heat to the wearer or into the air. For example, during typical cooling operations, warm coolant is circulated from the internal heat exchanger at the TEM to the external heat exchanger channel network on the outside of clothing. Heat is conducted, e.g., in a heat gradient, from the warm coolant to the exchanger block, to a fin assembly, and ultimately, to the exterior air. The heat exchanger fins can be fabricated from, e.g., durable heat conductive materials, such as steel, bronze, aluminum, copper, and the like. The coolant can continue circulating, e.g., through the pump and back to the internal heat exchanger to absorb additional heat from the interior of the clothing.

The Circulation Pump

The circulation pump of the invention, e.g., physically transfers heat laden coolant fluid between heat exchangers of circulating coolant loops. The pump can be of any suitable type known in the art, such as, e.g., a rotary pump, a piston pump, a bladder pump, and the like. The pump of the invention can be powered by, e.g., an electric motor or mechanical devices linked to body motions of the user.

In one embodiment of the invention, a bladder pump can circulate coolant around the circulation loop. Such a pump can include, e.g., a resilient bladder with an inlet port and an outlet port. The ports can have, e.g., one or more associated one-way check valves to allow fluid flow only into or out of the bladder, as appropriate. The bladder pump can be incorporated, e.g., in fabric folds of clothing articulations or within a resilient heal of footwear. As the user flexes his joints or steps on his heal, e.g., the bladder can be compressed to force coolant fluid out through the outlet port and past a check valve oriented outward. As the user extends his joints or lifts his heal, e.g., the bladder can resiliently expand back to the original shape to draw coolant fluid in through the inlet port and past a check valve oriented inward. Repeated user movements can thereby pump coolant fluid from the bladder pump and through the heat exchangers of the circulating coolant loop.

Figure 6:
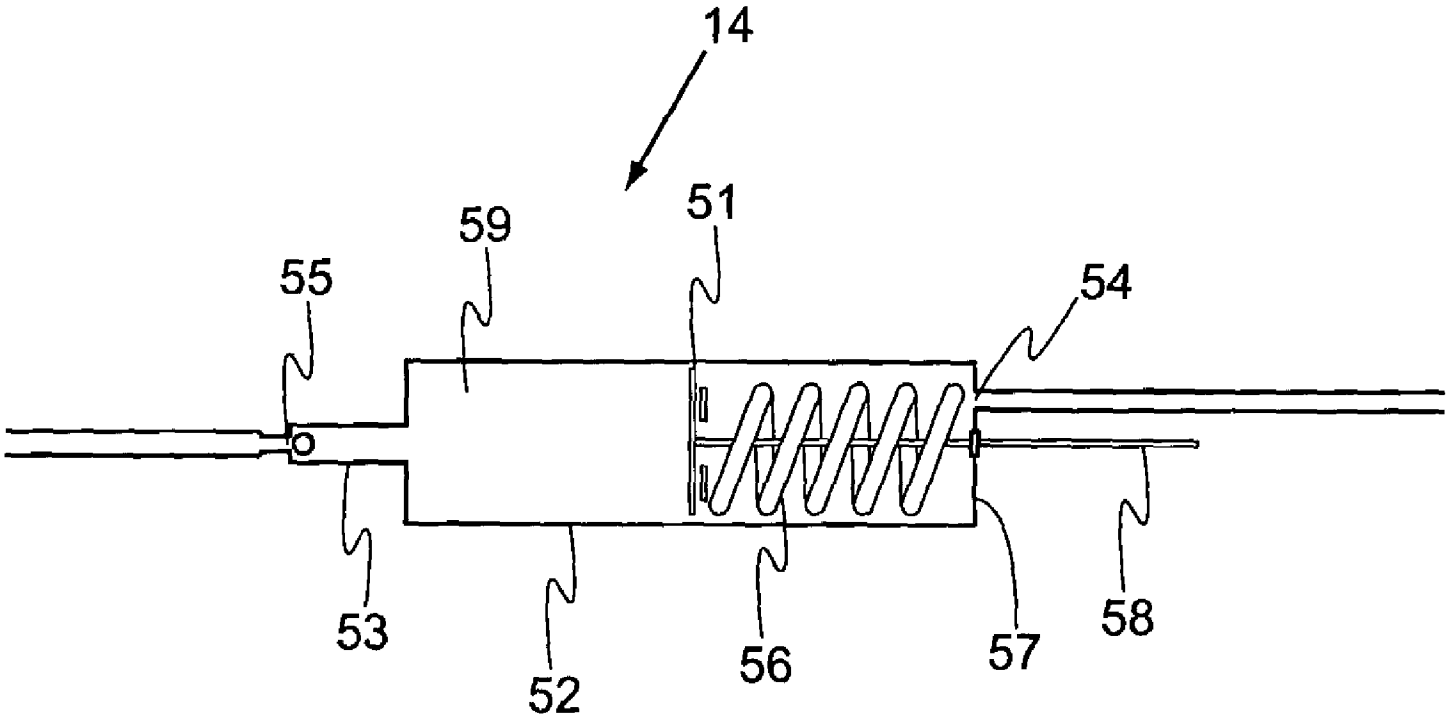
FIG. 6 is a schematic diagram of a piston style coolant circulating pump.

In another embodiment of the invention, the circulation pump can be configured, e.g., as a piston pump assembly. As shown in FIG. 6, for example, piston pump 14 comprises piston plate 51 hydraulically sealed and slidably mounted in pump cylinder 52. The cylinder can have, e.g., inlet port 53 and outlet port 54 fluidly connected to the circulating loop. The piston and/or cylinder can have one or more one-way check valves 55. One or more return springs 56 can be compressed, e.g., between piston plate 51 and cylinder end wall 57 to urge the piston plate to a resting position. Actuator shaft 58 can be, e.g., attached to piston plate 51 and extend outside of the pump, through a hydraulic seal and to a reciprocating power mechanism. In use, a pulling force on actuator shaft 58 causes piston plate 51 to slide within pump cylinder 52, thus reducing the volume of chamber 59 and forcing coolant fluid through outlet post 53 and around the circulating loop. As the pulling force on actuator shaft 58 is relaxed, piston plate 51 is urged back to resting position by return spring 56 while coolant passes through the check valves to refill chamber 59. Pulling force on the actuator shaft can initiate another pumping cycle.

Figure 7:
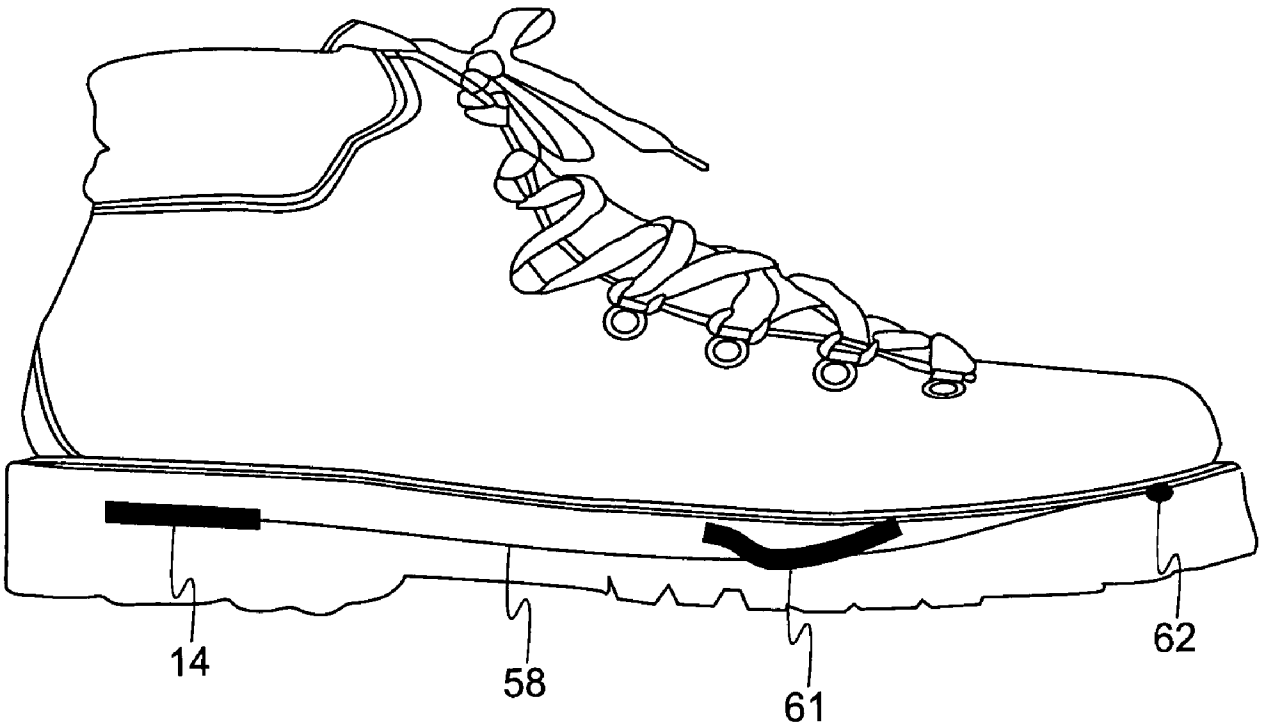
FIG. 7 is a schematic diagram of a pump actuating system.

The pulling force on the actuator shaft can be provided, e.g., by the walking motion of a user, as shown in FIG. 7. Piston pump 14 can be, e.g., mounted in the heal of footwear with actuator shaft 58 extending, in slidable contact over fulcrum 61, to shaft anchor 62 mounted in sole 21. As the user bends sole 21 while walking, the distance increases from piston pump 14, over fulcrum 61, to shaft anchor 62, causing a pulling force on actuator shaft 58. As the user lifts her foot and sole 21 returns to a straightened position, pulling force on actuator shaft 58 is relaxed. Such a cycle of pulling force and relaxation on actuator shaft 58 is well adapted to powering piston pump 14.

The hydraulic seals of the invention can be provided, e.g., by precision fitting parts and/or by using resilient o-rings. The o-rings can be fabricated from, e.g., neoprene rubber.

Figure 10:
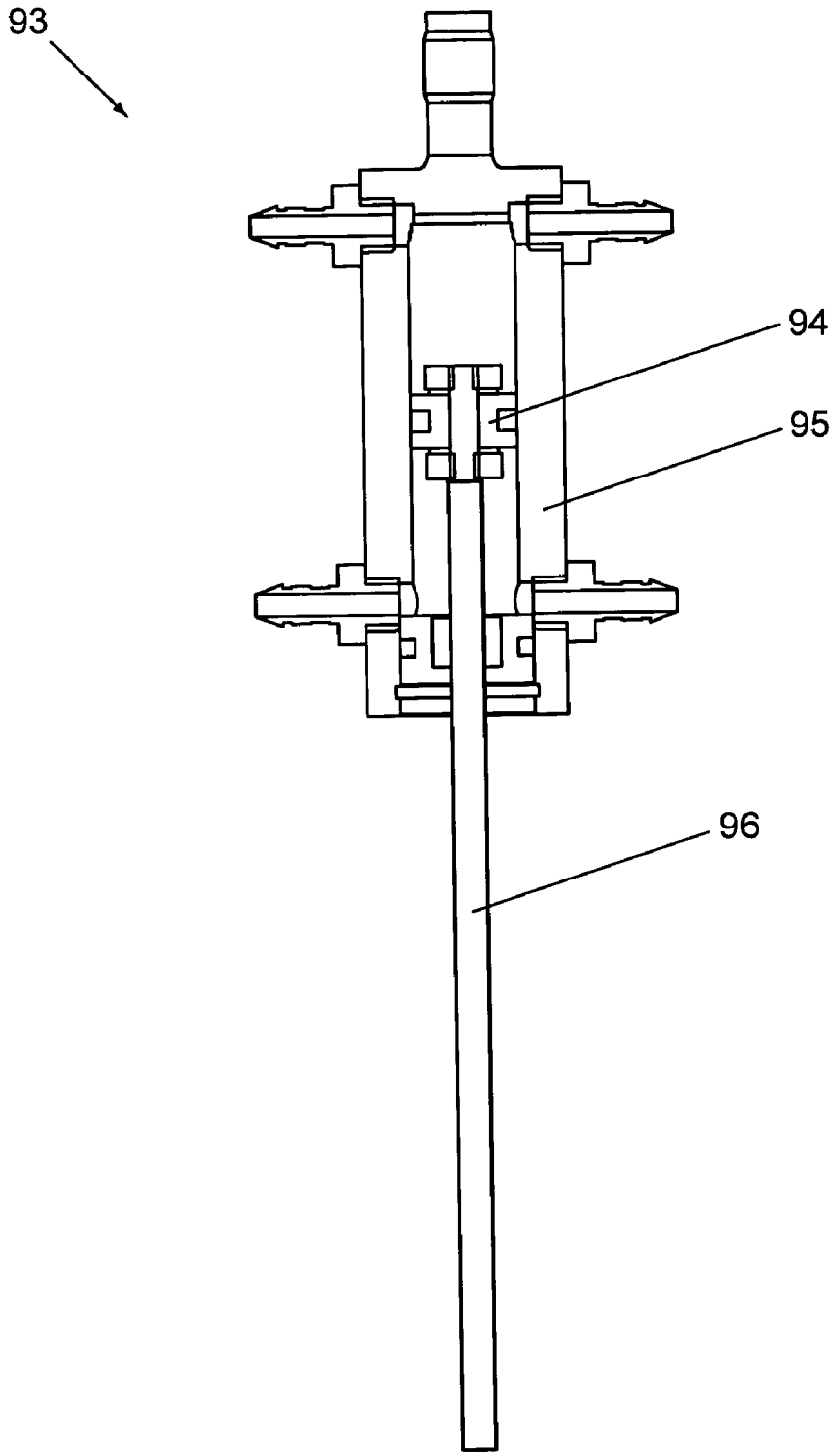
FIG. 10 is a schematic diagram of a dual action piston pump.

The circulation pump can be a dual action pump, as shown in FIG. 10, wherein the fluid can be delivered to a circulation with every stroke of the actuator shaft. Such a pump can be used to provide, e.g., enhanced volume flows and/or circulation of fluids in two circulation loops using a single pump.

Check valves of the invention can have any suitable design. For example, the check valves can be ball and seat valves with or without spring return mechanisms. In another example, the check valves can be reed valves or baffle plate valves with or without spring return mechanisms.

The Coolant Fluid

The coolant fluid of the invention can be contained, e.g., within conduits, chambers, and channels of the circulating coolant loop. The Coolant can, e.g., absorb heat and release heat according to temperature gradients experienced within the heat exchangers of the invention.

The coolant fluid can be, e.g., any fluid, or fluid formulation, with suitable qualities of stability, materials compatibility, heat capacity, and viscosity. Suitable coolant fluids can include, e.g., water, mineral oil, silicone oil, and the like.

Method of Clothing Temperature Regulation

The temperature inside of clothing, such as, e.g., shoes, gloves, hats, pants, and shirts, can be regulated by application of electric current to a thermo-electric module which is incorporated into the clothing. The temperature can be, e.g., raised or lowered. Control systems can be used to provide, e.g., more efficient, consistent, and convenient temperature control. Circulating heat exchange systems can be used, e.g., to provide increased heat transfer rates.

EXAMPLE 1

Methods of Cooling

A TEM is incorporated into, e.g., the sole of a shoe and direct current voltage is applied across the TEM from a battery mounted in the heal. The polarity of the voltage is selected so that the cold TEM side faces inside the shoe. A user puts on the shoe. Heat is transferred from the user's foot to the sole of the shoe where is can be conducted into the external environment.

The efficiency of cooling is increased by bonding a heat conducting plate, e.g., on the inside of the TEM. The heat conducting plate can have a larger surface area than the TEM to collect (or disperse) heat over a wide area within the shoe. The heat conducting plate is made of an aluminum sheet to rapidly conduct heat to the TEM.

The efficiency of cooling can be increased by installing one or more circulating coolant loops into the shoe. An internal heat exchanger is mounted under the TEM to absorb heat transferred from the foot. A circulation pump is mounted in the heal of the shoe and actuated by walking mechanics of the user. A coolant fluid absorbs heat in the internal heat exchanger and is pumped to the external heat exchanger where the heat is dissipated into the air. With the circulating coolant loop in use, heat transferred to the warm side of the TEM does not have to slowly conduct through the shoe sole. The heat is rapidly transferred in a high heat capacity coolant to the external heat exchanger for efficient dissipation from a large surface area of cooling fins in contact with cool air.

Efficiency of cooling is increased by installing a temperature control system in the shoe. The user selects a comfortable shoe temperature by turning the dial on a temperature selection device in electrical communication with a power control circuit. The circuit determines the shoe temperature from a signal provided by a shoe temperature sensor in electrical contact with the control circuit. If the shoe temperature is above the selected temperature, the circuit passes voltage from the battery to the TEM to cool the shoe. When the circuit detects the shoe is cooled to the selected temperature, the circuit stops passage of voltage from the battery to the TEM. The TEM does not waste energy by cooling the shoe beyond the setting. While the TEM is not energized, the temperature differential at the junction drops so heat transfer can be more efficient at the start of the next cooling cycle.

EXAMPLE 2

Methods of Warming

A TEM is incorporated into the, e.g., palm of a mitten and a DC voltage is applied across the TEM from a battery mounted on the cuff. The polarity of the voltage is selected so that the warm TEM side faces inside the mitten. A user puts on the mitten. Resistive heat is generated within the TEM and transferred to the hand. Ambient heat from the surrounding air is also transferred to the user's hand by the TEM.

Figure 8:
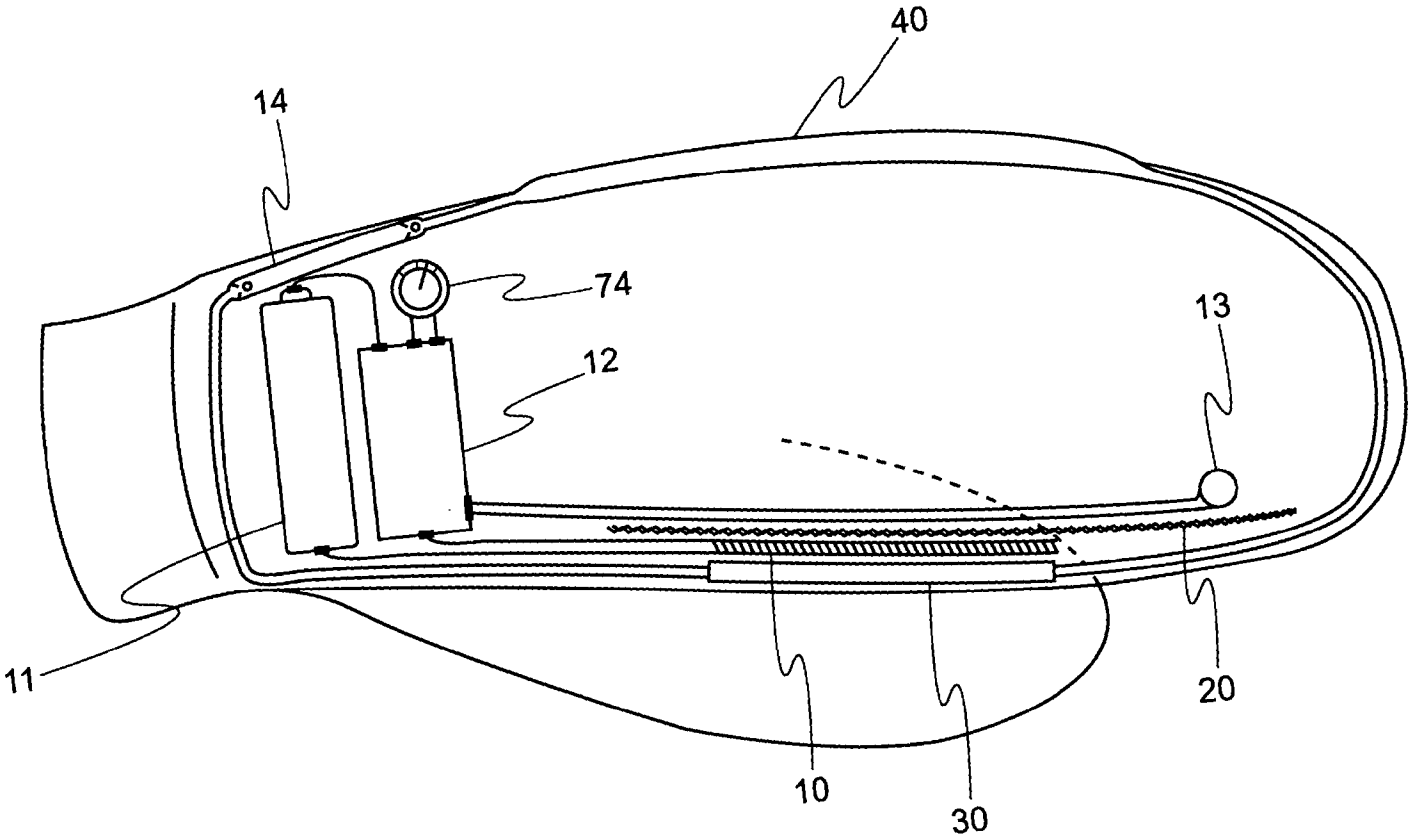
FIG. 8 is a schematic diagram of a temperature regulated mitten.

The efficiency of warming is increased by bonding heat conducting plate 20 inside of the TEM, as shown in FIG. 8. The heat conducting plate has a larger surface area than the TEM to distribute heat over a wider area within the mitten. The heat conducting plate is made of a fine flexible stainless steel mesh to rapidly conduct heat from the TEM.

The efficiency of warming is increased by installing a circulating coolant loop into the mitten. External heat exchanger 40 is mounted on the back exterior of the mitten to absorb heat from the ambient air into a coolant fluid. Bladder style circulation pump 14 is mounted in the fabric on the back side of the mitten wrist area, for actuation by flexion and extension of the user's wrist, to circulate the fluid from external heat 40 exchanger to internal heat exchanger 30. The internal heat exchanger is mounted outside of the TEM 10 to provide heat to the cold side. The heat transferred to the cold side of the TEM reduces the temperature differential across the junction allowing more heat to flow with the same applied voltage.

Efficiency of warming is increased by installing a temperature control system in the mitten. The user selects a comfortable mitten temperature by turning a dial on temperature selection device 74 in electrical communication with power control circuit 12. The circuit determines the mitten temperature from a signal provided by mitten temperature sensor 13 in electrical contact with the circuit. If the mitten temperature is below the selected temperature, the circuit passes voltage from battery 11 to the TEM to warm the mitten. When the circuit detects the mitten is warmed to the selected temperature, the circuit stops passage of voltage from the battery to the TEM. The TEM does not waste energy by heating the mitten beyond the selected temperature. While the TEM is not energized, the temperature differential across the junction drops so heat transfer is more efficient at the start of the next warming cycle.

EXAMPLE 3

Temperature Regulated Clothing with Dual Heat Exchange Circulations

The presence of circulating coolant loops on each side of the TEM in temperature regulated clothing can, e.g., enhance the efficiency of TEM operation, and allow heat transfer to broader or more remote locations of the clothing. The circulation of coolant fluid within two or more coolant loops can be driven by one or more circulation pumps.

Figure 9:
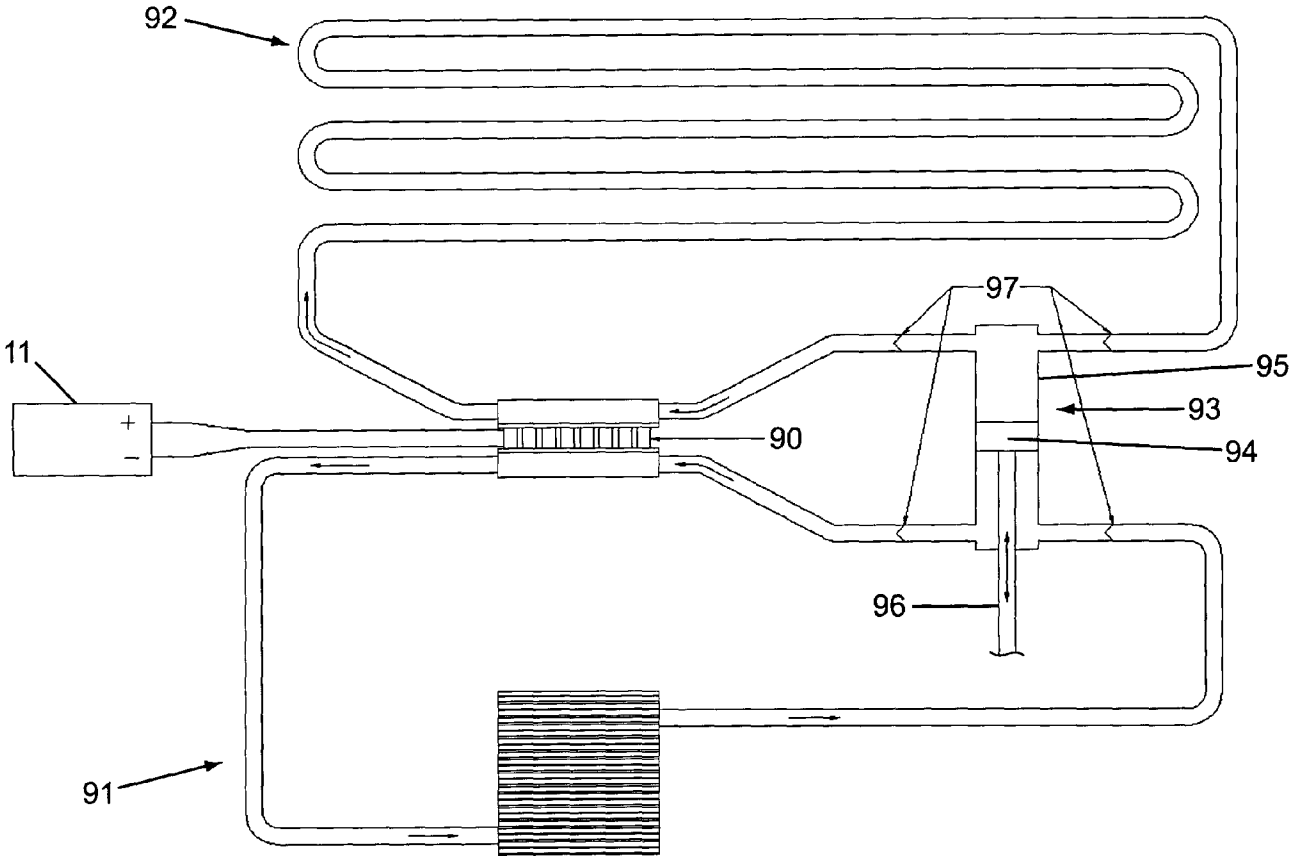
FIG. 9 is a schematic diagram of a dual circulating loop heat exchange system for temperature regulated clothing.

A dual circulating loop heat exchange system for temperature regulated clothing is shown in FIG. 9. Such systems can operate essentially as in previous examples, but with a second circulating loop replacing the heat conductor plate. The dual circulating loop system includes, e.g., TEM 90 in contact on one side with external heat exchange circulating coolant loop 91, and in contact on the other side with internal heat exchange circulating coolant loop 92.

Circulation pump 93 is a dual action pump providing circulation in both coolant loops. Piston plate 94 is slidably mounted in pump cylinder 95 to draw in fluid on one side while expelling fluid from the other side with each stroke of actuator shaft 96, as shown in FIGS. 9 and 10. Check valves 97 control the direction of coolant fluid flow for each loop.

In a configuration to cool the wearer of the temperature regulated clothing, internal heat exchange circulating coolant loop 92 circulates to the inside of temperature regulated clothing to remove heat from the wearer and deliver it to the cold side of the TEM. The external heat exchange circulating coolant loop 91 circulates to the outside of the temperature regulated clothing to remove heat from the hot side of the TEM and deliver it to the external environment. Optionally, a dual circulating loop system can have separate pumps, as described in the "Circulation Pump" section, dedicated to circulation of fluids in the individual circulation loops. Optionally, the sides of the TEM can be reversed to carry heat from the external environment to the wearer, as will be appreciated by those skilled in the art.

It is understood that the examples and embodiments described herein are for illustrative purposes only and that various modifications or changes in light thereof will be suggested to persons skilled in the art and are to be included within the spirit and purview of this application and scope of the appended claims.

All publications, patents, and patent applications cited herein are hereby incorporated by reference in their entirety for all purposes.

What is claimed is:

1. Temperature regulated non-pressurized clothing comprising:

footwear comprising an outer surface;

a thermo-electric module in electrical contact with an electrical power source;

a circulating coolant loop of liquid coolant fluid in contact with a side of the thermo-electric module, wherein said contact provides heat exchange; and, an external heat exchanger mounted to the footwear outer surface and in contact with the thermo-electric module or in contact with the coolant loop;

wherein if the external heat exchanger is not in contact with the coolant loop, then the coolant loop is at least in contact with an internal heat exchanger mounted inside the footwear;

whereby, during operation, heat is exchanged between air and the external heat exchanger.

2. The clothing of claim 1, wherein the power source is portable.

3. The clothing of claim 1, wherein the electrical contact is polarized to orient heat transfer out of the clothing.

4. The clothing of claim 1, wherein the electrical contact is polarized to orient heat transfer into the clothing.

5. The clothing of claim 1, wherein the thermo-electric module can be mounted to the clothing by the user alternately with a cold side facing inward or with a warm side facing inward, whereby the user can select a cooling or warming operation.

6. The clothing of claim 1, further comprising dual circulating coolant loops in contact with the thermo-electric module.

7. The clothing of claim 1, further comprising a condensation drainage tube in association with a cold side of the thermo-electric module.

8. The clothing of claim 1, further comprising a temperature control system comprising:

a temperature sensor mounted to the clothing;

a solid state power control circuit comprising one or more temperature signal input terminals in communication with the temperature sensor, one or more controlled power output terminals in electrical contact with the thermo-electric module, and one or more power input terminals; and, a battery comprising an electrical voltage and in electrical contact with the power input terminals;

whereby the control circuit adjusts a power supplied to the thermo-electric module in response to a temperature sensor signal, thereby controlling a clothing temperature.

9. The clothing of claim 8, wherein the temperature sensor comprises a thermistor.

10. The clothing of claim 8, wherein the solid state circuit comprises one or more integrated circuit or EPROM.

11. The clothing of claim 8, further comprising a temperature selection device in electrical contact with one or more control circuit temperature selection input terminals, whereby a user can select a desired clothing temperature.

12. The clothing of claim 8, wherein the battery is rechargeable.

13. The clothing of claim 1, wherein the circulating coolant loop compnses:

the internal heat exchanger in contact with the side of the thermo-electric module, and comprising one or more first coolant channels;

the external heat exchanger comprises one or more second coolant channels fluidly coupled to the first coolant channels;

a circulation pump fluidly coupled to the first and second coolant channels, thereby providing a circulating coolant loop; and, a coolant fluid retained within the coolant loop.

14. The clothing of claim 13, wherein the internal heat exchanger further comprises a heat exchanger plate in contact with the side of the thermo-electric module or a second circulating coolant loop in contact with the other side of the thermo-electric module.

15. The clothing of claim 13, wherein the external heat exchanger further comprises one or more heat exchange fins.

16. The clothing of claim 15, wherein the heat exchange fins comprise copper, aluminum, or bronze.

17. The clothing of claim 13, wherein the external heat exchanger further comprises a backing layer comprising thermal insulation.

18. The clothing of claim 13, wherein the circulating pump comprises one or more chambers, and two or more check valves directing coolant flow through the chambers and the loop.

19. The clothing of claim 18, wherein the circulating pump chamber comprises a resilient bladder.

20. The clothing of claim 18, wherein the circulating pump chamber comprises a piston and a cylinder.

21. The clothing of claim 20, wherein the pump comprises a dual action pump.

22. The clothing of claim 18, wherein the check valves comprise a reed valve, or a ball and seat valve.

23. The clothing of claim 18, wherein the clothing comprises footwear and the chamber comprises a cylindrical wall, and the circulating pump further comprises:

a piston plate hydraulically sealed and slidably mounted within the cylinder wall; and, an actuator shaft attached to the piston plate and extending to a shaft anchor mounted to a sole of the footwear.

24. The clothing of claim 23, further comprising an o-ring mounted between the piston plate and the cylinder wall, thereby providing the hydraulic seal.

25. The clothing of claim 23, further comprising a return spring compressed between one side of the piston plate and a pump chamber wall.

26. The clothing of claim 23, further comprising a fulcrum mounted to the sole between the pump and the anchor in slidable contact with the actuator shaft.

27. The clothing of claim 13, wherein the coolant comprises water, mineral oil or silicone oil.

28. Temperature regulated non-pressurized clothing comprising:

a thermo-electric module mounted to the clothing;

a temperature sensor mounted to the clothing;

a solid state power control circuit comprising a temperature signal input terminal in communication with the temperature sensor, a controlled power output terminal in electrical contact with the thermo-electric module, and a power input terminal;

a battery in electrical contact with the power input terminal and comprising an electrical voltage;

an internal heat exchanger in contact with a side of the thermo-electric module, and comprising one or more first coolant channels;

an external heat exchanger comprising one or more second coolant channels fluidly coupled to the first coolant channels, and mounted on an outer surface of the clothing;

a circulation pump fluidly coupled to the first and second coolant channels, thereby providing a circulating coolant loop; and, a liquid coolant fluid retained within the coolant loop;

whereby the control circuit monitors the temperature at the temperature sensor and adjusts a power supply to the thermo-electric module, thereby regulating the clothing temperature; and, whereby heat is exchanged between the thermo-electric module and the heat exchangers, thereby increasing the rate of heat transfer for temperature regulation of the clothing.

29. A method of regulating temperatures of footwear, the method comprising:

applying electric power to a thermo-electric module incorporated into the footwear and, transferring heat to or from the thermo-electric module with a circulating coolant fluid in a circulating coolant loop of liquid coolant fluid;

whereby heat is transferred from air into the footwear or transferred from the footwear into the air.

30. The method of claim 29, further comprising selecting a lower footwear temperature by polarizing the electric power to orient heat transfer out of the footwear.

31. The method of claim 29, further comprising selecting an increased footwear temperature by polarizing the electric power to orient heat transfer out of the footwear.

* * * * *